US010876496B2

(12) United States Patent
Choudhary et al.

(10) Patent No.: US 10,876,496 B2
(45) Date of Patent: Dec. 29, 2020

(54) APPARATUS AND METHOD TO AVOID FRETTING FATIGUE IN AN ENGINE BLOCK

(71) Applicant: GM Global Technology Operations LLC, Detroit, MI (US)

(72) Inventors: Lokesh Choudhary, Bangalore (IN); Bala K. Sela, Rochester Hills, MI (US); Paul J. Boone, Rochester Hills, MI (US); Tiruttani Munikamal, Bengaluru (IN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 4 days.

(21) Appl. No.: 16/415,566

(22) Filed: May 17, 2019

(65) Prior Publication Data

US 2020/0362793 A1 Nov. 19, 2020

(51) Int. Cl.
*F02F 7/00* (2006.01)
*B22D 19/00* (2006.01)

(52) U.S. Cl.
CPC ..... *F02F 7/0021* (2013.01); *B22D 19/00* (2013.01); *F02F 7/0085* (2013.01); *F02F 2200/06* (2013.01)

(58) Field of Classification Search
CPC .... F02F 7/0021; F02F 7/0085; F02F 2200/06; B22D 19/00; B22D 19/0009; B22D 19/0018
See application file for complete search history.

(56) References Cited

U.S. PATENT DOCUMENTS 5,676,105 A * 10/1997 Schwaderlapp ..... F02B 77/13 123/195 H
2005/0161187 A1* 7/2005 Kodama ..... F02F 7/00 164/66.1

* cited by examiner

*Primary Examiner* — Jacob M Amick

(57) ABSTRACT

An apparatus for a motor vehicle engine block made of aluminum includes an insert having a first surface and a second surface spaced apart from the first surface, the first surface being substantially flat, and a plurality of projections extending from the second surface, the plurality of projections being inserted into a portion of the engine block to secure the insert to the portion of the engine block. The first surface of the insert is configured to mate with another component, other than the engine block, made of steel or cast iron to avoid fatigue fretting of the aluminum engine block.

16 Claims, 5 Drawing Sheets

APPARATUS AND METHOD TO AVOID FRETTING FATIGUE IN AN ENGINE BLOCK

INTRODUCTION

The present disclosure relates to an apparatus to avoid fretting fatigued in an engine block for a motor vehicle.

In many motor vehicles, the motor vehicles are powered by an engine, such as, for example, an internal combustion engine. Some of these engines are formed from an aluminum block. Various portions of these engine blocks are in contact with each other such that relative motion between the portions result in fretting fatigue, particularly in the aluminum components of the engine block.

Thus, while current engine blocks achieve their intended purpose, there is a need for a new and improved apparatus and method for fabricating engine blocks to avoid fretting fatigue in the engine block.

SUMMARY

According to several aspects, an apparatus for a motor vehicle engine block made of aluminum includes an insert having a first surface and a second surface spaced apart from the first surface, the first surface being substantially flat, and a plurality of projections extending from the second surface, the plurality of projections being inserted into a portion of the engine block to secure the insert to the portion of the engine block. The first surface of the insert is configured to mate with another component, other than the engine block, made of steel or cast iron to avoid fatigue fretting of the aluminum engine block.

In another aspect of the present disclosure, the insert is made of cast iron.

In another aspect of the present disclosure, the second surface is a grooved wavy surface.

In another aspect of the present disclosure, each of the plurality of projections includes a first portion that extends substantially perpendicular to the second surface.

In another aspect of the present disclosure, each of the plurality of projections includes a second portion that extends substantially perpendicular in one direction to the first portion of the extension.

In another aspect of the present disclosure, each of the plurality of projections includes a second portion that extends substantially perpendicular in two directions to the first portion of the extension.

In another aspect of the present disclosure, each of the plurality of projections has an L-shape.

In another aspect of the present disclosure, each of the plurality of projections has a T-shape.

According to several aspects, an apparatus for a motor vehicle engine block made of aluminum includes an insert having a first surface and a second surface spaced apart from the first surface, the first surface being substantially flat and the second surface being a grooved wavy surface, the insert being formed of cast iron, and a plurality of projections extending from the second surface, the plurality of projections being inserted into a portion of the engine block to secure the insert to the portion of the engine block as the portion of the engine block is being cast. The first surface of the insert is configured to mate with another component, other than the engine block, made of steel or cast iron to avoid fatigue fretting of the aluminum engine block.

In another aspect of the present disclosure, each of the plurality of projections has an L-shape.

In another aspect of the present disclosure, each of the plurality of projections has a T-shape.

According to several aspects, a method to avoid fretting fatigue in an engine block for a motor vehicle includes one or more of the following: placing an insert in a mold, the insert having a first surface and a second surface spaced apart from the first surface, the first surface being substantially flat, a plurality of projections extending from the second surface; and pouring a liquid aluminum into the mold to form a portion of the engine block, the plurality of projections being inserted into the portion of the engine block to secure the insert to the portion of the engine block. The first surface of the insert is configured to mate with another component, other than the engine block, made of steel or cast iron to avoid fatigue fretting of the aluminum engine block.

In another aspect of the present disclosure, the insert is made of cast iron.

In another aspect of the present disclosure, the second surface is a grooved wavy surface.

In another aspect of the present disclosure, each of the plurality of projections has an L-shape.

In another aspect of the present disclosure, each of the plurality of projections has a T-shape.

In another aspect of the present disclosure, each of the plurality of projections includes a first portion that extends substantially perpendicular to the second surface.

In another aspect of the present disclosure, each of the plurality of projections includes a second portion that extends substantially perpendicular in at least one direction to the first portion of the extension.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
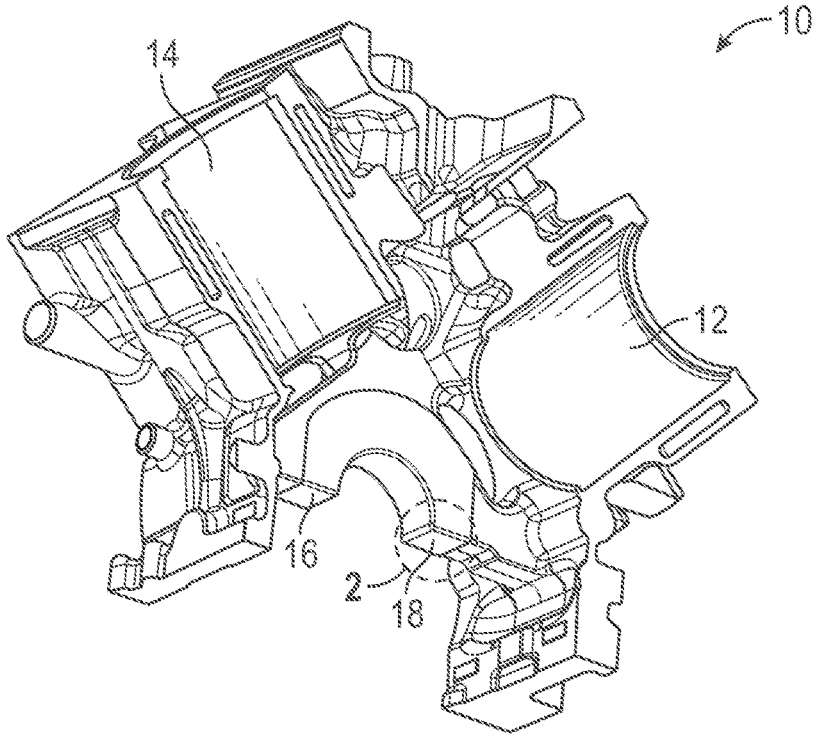
FIG. 1 is a perspective view of a portion of an engine block.
Figure 2:
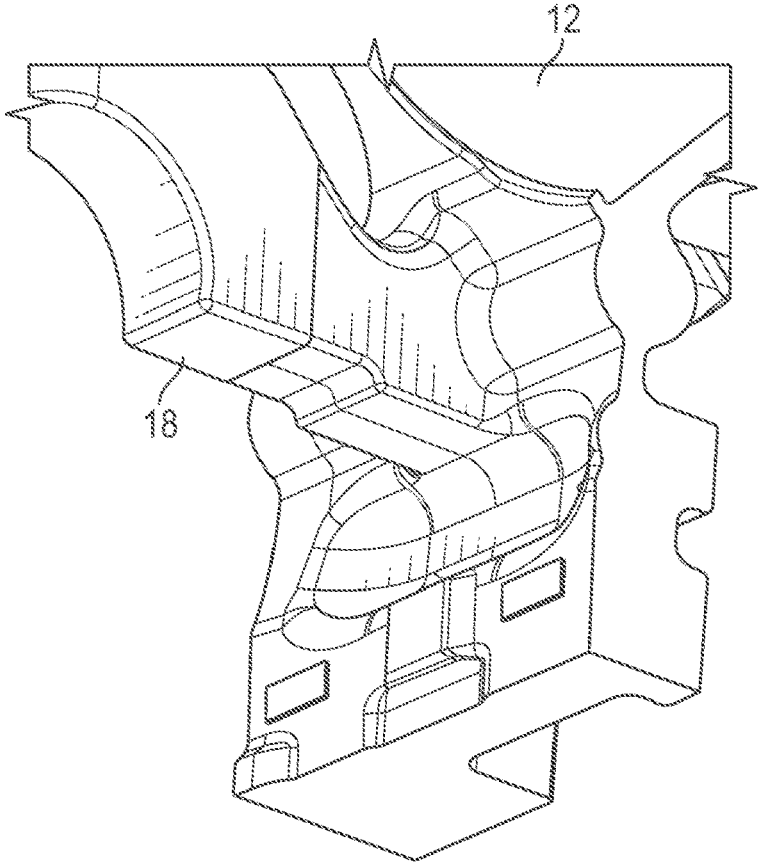
FIG. 2 is a close-up view of a region of the engine block shown in FIG. 1.

Referring to FIGS. 1 and 2, there are shown a portion of an engine block 10 with a bore 12 and a bore 14. The portion of the engine block 10 is made of aluminum and includes substantially flat surfaces 16 and 18. In prior engine blocks, the flat surfaces 16 and 18 mate with corresponding flat surfaces of another component made, for example, of cast iron or steel. The contact between the portions potentially resulted in fatigue failure because of material biting and fretting wear. That is, such fretting fatigue occurs as a result from the relative motion of the components of the engine block made from aluminum and components made of steel or iron.

Figure 3:
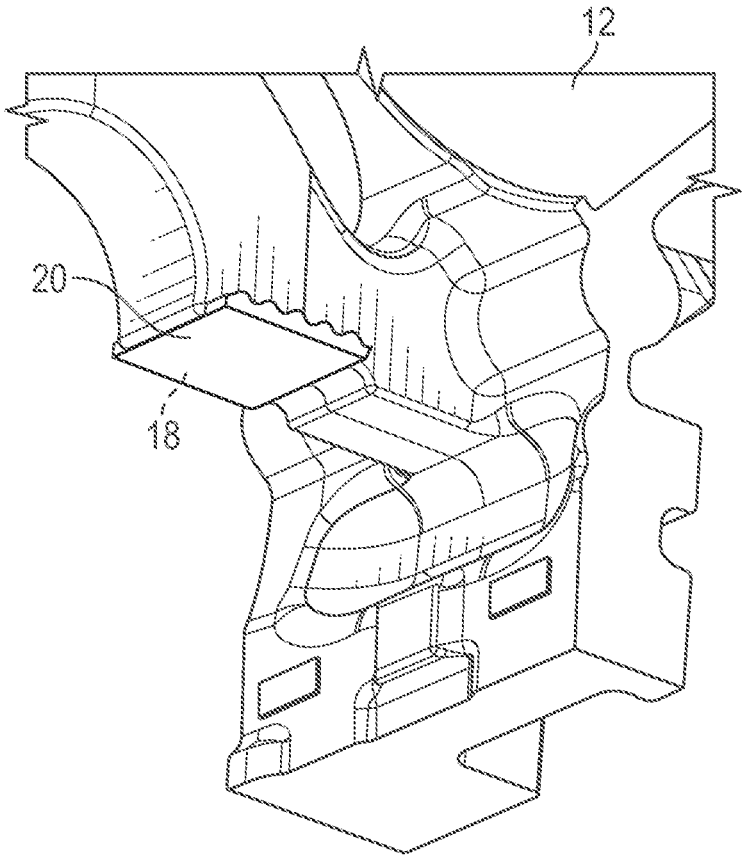
FIG. 3 is a close-up view of the region of the engine block with an insert according to an exemplary embodiment.
Figure 4:
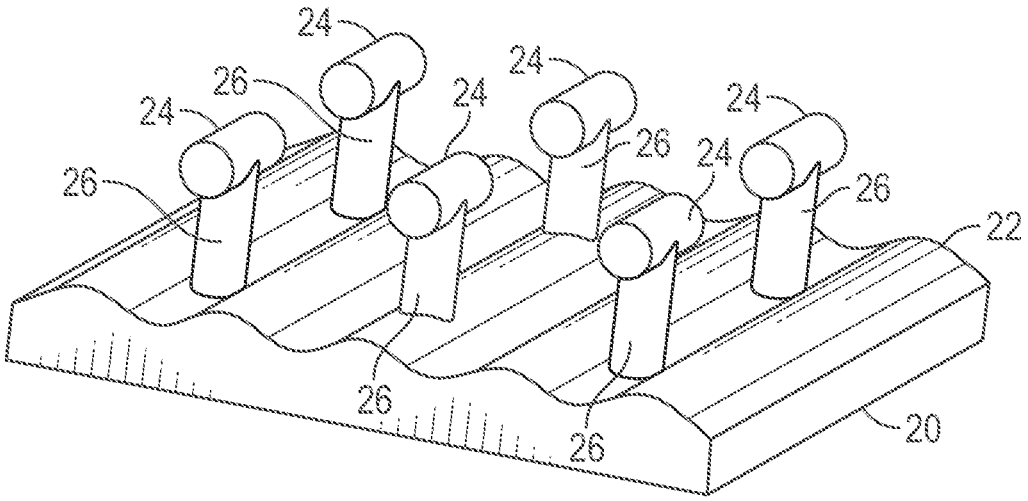
FIG. 4 is a perspective view of the insert according to an exemplary embodiment.

Turning now to FIG. 3, there is shown the portion of the engine block 10 with an insert 18 that is secured to the surface 20 to prevent fretting fatigue of the surface 20. In various arrangements, the insert 18 is made of a metal, such as, for example, cast iron. During the fabrication of the portion of the engine block 10, the insert 18 is placed in a mold, such as a sand core cast, and the molten aluminum is poured into the mold. As the mold and the aluminum is cooled, the portion of the engine block 10 is formed with the insert 18 secured to the surface 20.

In particular arrangements, the insert 20 includes a grooved wavy surface 22 to enhance the bonding between the insert 20 and the surface 18. Further, in various arrangements, the insert includes a set of projections with a first portion 26 that extends substantially perpendicular from the grooved wavy surface 22. Each of the plurality of projections also includes a second portion 24 that extends substantially perpendicular to the first portion 26 in two directions such that the projections have a T-shape. Accordingly, when the first portion 26 and the second portion 24 are inserted into the portion of the engine block 10, the plurality of projections further enhances the bonding of the insert 20 to the surface 18.

Figure 5:
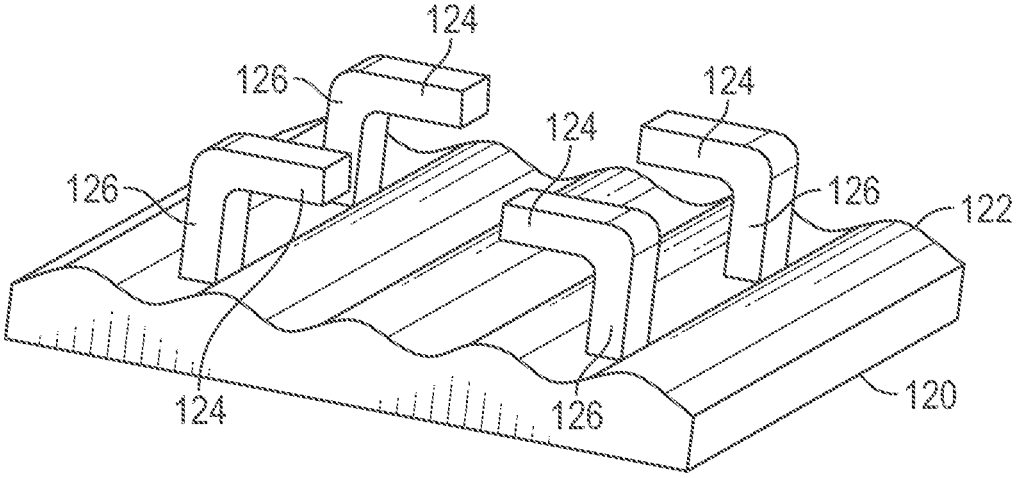
FIG. 5 is a perspective view of an alternative insert according to an exemplary embodiment.

Referring to FIG. 5, there is shown an alternative insert 120. The insert 120 includes a grooved wavy surface 122 to enhance the bonding between the insert 120 and the surface 18 of the portion of the engine block 10. The insert 120 includes a set of projections with a first portion 126 that extends substantially perpendicular from the grooved wavy surface 122. Each of the plurality of projections also includes a second portion 124 that extends substantially perpendicular to the first portion 26 such that the projections have a L-shape. Accordingly, when the first portion 126 and the second portion 124 are inserted into the portion of the engine block 10, the plurality of projections further enhances the bonding of the insert 120 to the surface 18.

Figure 6:
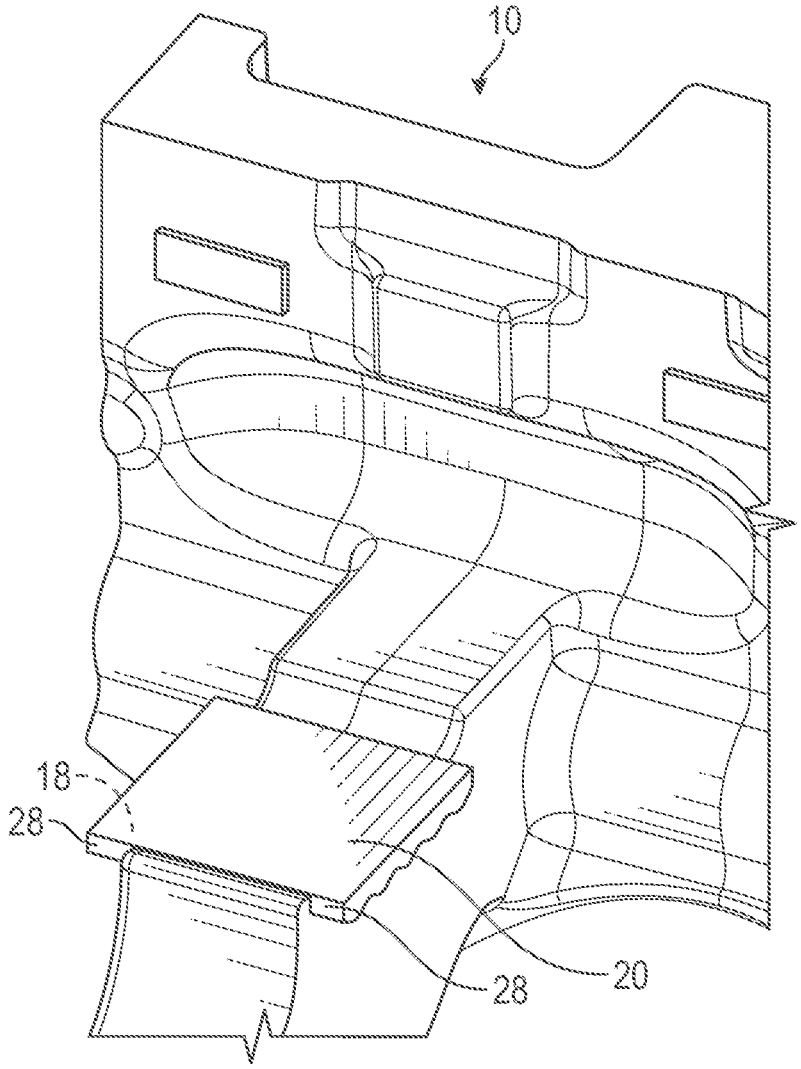
FIG. 6 is a perspective view of an insert with edges that are removed according to an exemplary embodiment.

Referring to FIG. 6, there is shown the insert 20 with edges 28 that provide support to the insert 20 when placed in the aforementioned mold. During the fabrication of the portion of the engine block 10, the edges 28 are removed, for example, by a machining process.

Figure 7:
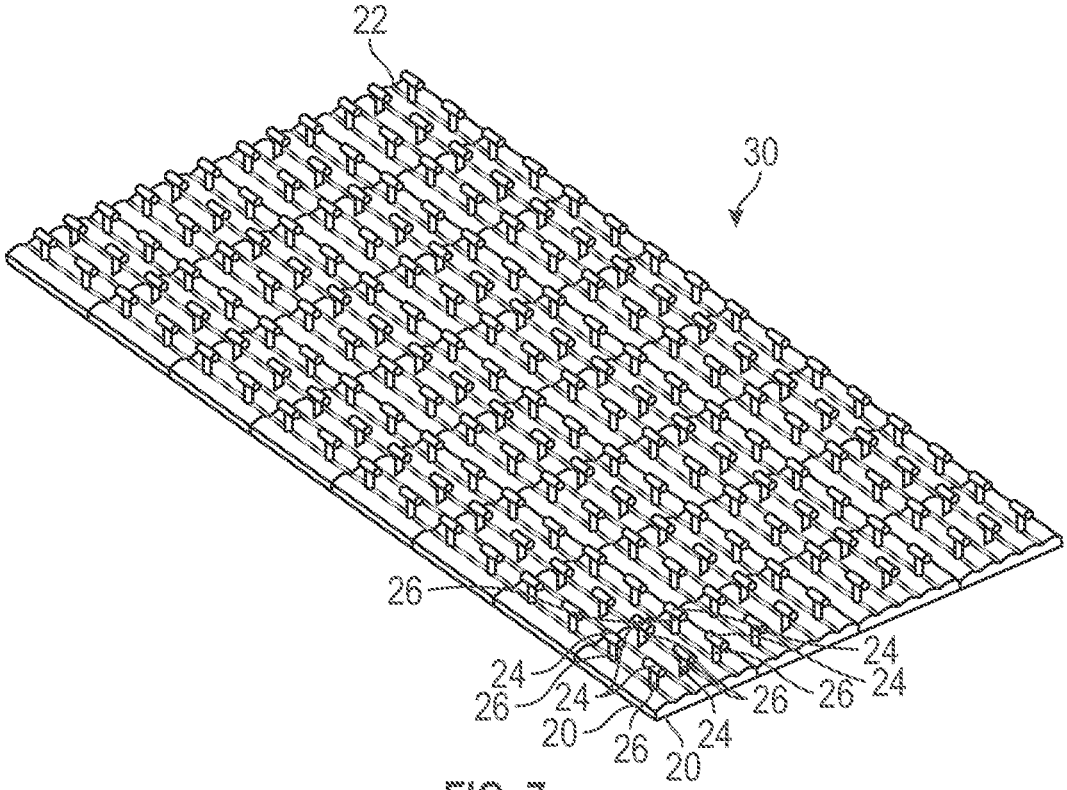
FIG. 7 is a perspective view of a panel of an insert according to an exemplary embodiment.
Figure 8:
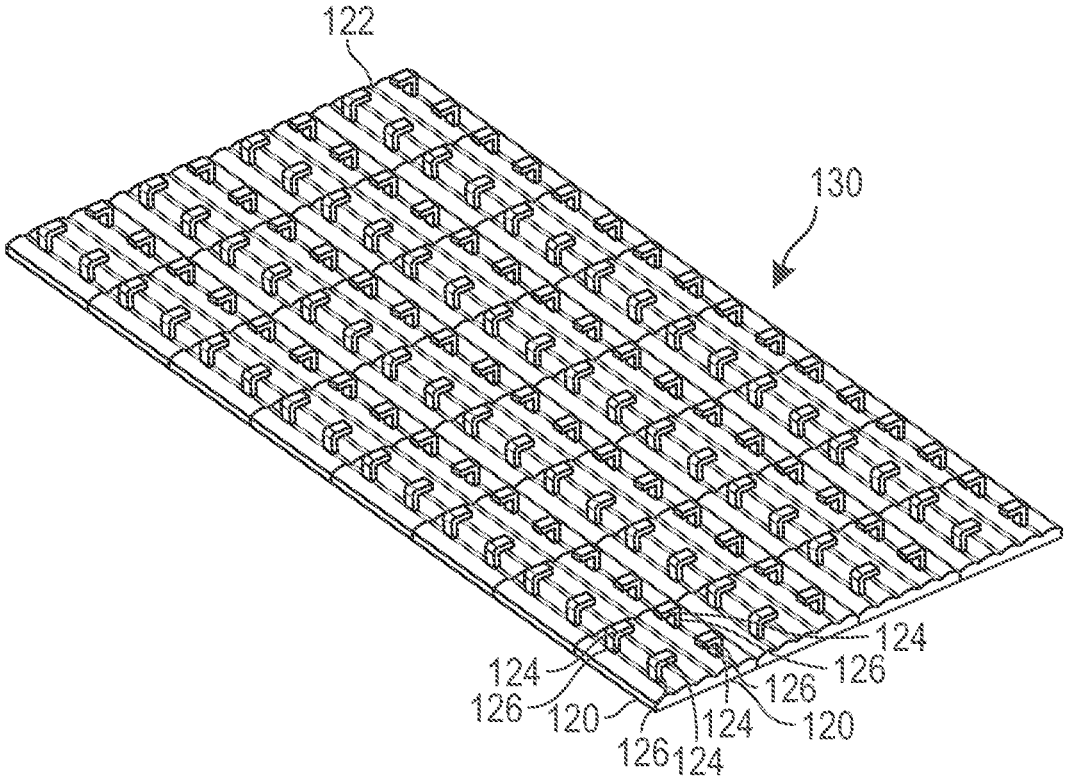
FIG. 8 is a perspective view of a panel of an alternative insert according to an exemplary embodiment.

Referring to FIG. 7, there is shown how each of the inserts 20 are fabricated from a panel 30 in various arrangements. FIG. 8 illustrates how each of the inserts 120 are fabricated from a panel 130 in other arrangements.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An apparatus for a motor vehicle engine block made of aluminum, the apparatus comprising:

an insert having a first surface and a second surface spaced apart from the first surface, the first surface being substantially flat, the second surface being a grooved wavy surface; and a plurality of projections extending from the second surface, the plurality of projections being inserted into a portion of the engine block to secure the insert to the portion of the engine block, wherein the first surface of the insert is configured to mate with another component, other than the engine block, made of steel or cast iron to avoid fatigue fretting of the engine block.

2. The apparatus of claim 1, wherein the insert is made of cast iron.

3. The apparatus of claim 1, wherein each of the plurality of projections includes a first portion that extends substantially perpendicular to the second surface.

4. The apparatus of claim 3, wherein each of the plurality of projections includes a second portion that extends substantially perpendicular in one direction to the first portion of the plurality of extensions.

5. The apparatus of claim 3, wherein each of the plurality of projections includes a second portion that extends substantially perpendicular in two directions to the first portion of the plurality of extensions.

6. The apparatus of claim 1, wherein each of the plurality of projections has an L-shape.

7. The apparatus of claim 1, wherein each of the plurality of projections has a T-shape.

8. An apparatus for a motor vehicle engine block made of aluminum, the apparatus comprising:

an insert having a first surface and a second surface spaced apart from the first surface, the first surface being substantially flat and the second surface being a grooved wavy surface, the insert being formed of cast iron; and a plurality of projections extending from the second surface, the plurality of projections being inserted into a portion of the engine block to secure the insert to the portion of the engine block as the portion of the engine block is being cast, wherein the first surface of the insert is configured to mate with another component, other than the engine block, made of steel or cast iron to avoid fatigue fretting of the aluminum engine block.

9. The apparatus of claim 8, wherein each of the plurality of projections has an L-shape.

10. The apparatus of claim 8, wherein each of the plurality of projections has a T-shape.

11. A method to avoid fretting fatigue in an engine block for a motor vehicle, the method comprising:

placing an insert in a mold, the insert having a first surface and a second surface spaced apart from the first surface, the first surface being substantially flat, the second surface being a grooved wavy surface, a plurality of projections extending from the second surface; and pouring liquid aluminum into the mold to form a portion of the engine block made of aluminum, the plurality of projections being inserted into the portion of the engine block to secure the insert to the portion of the engine block, wherein the first surface of the insert is configured to mate with another component, other than the engine block, made of steel or cast iron to avoid fatigue fretting of the engine block.

12. The method of claim 11, wherein the insert is made of cast iron.

13. The method of claim 11, wherein each of the plurality of projections has an L-shape.

14. The method of claim 11, wherein each of the plurality of projections has a T-shape.

15. The method of claim 11, wherein each of the plurality of projections includes a first portion that extends substantially perpendicular to the second surface.

16. The method of claim 15, wherein each of the plurality of projections includes a second portion that extends substantially perpendicular in at least one direction to the first portion of the plurality of extensions.

* * * * *